United States Patent [19]

Gerich

[11] Patent Number: 4,971,450

[45] Date of Patent: Nov. 20, 1990

[54] INTERFACIAL SURFACE GENERATOR

[76] Inventor: Horst Gerich, 24034 Welby Way, Canoga Park, Calif. 91307

[21] Appl. No.: 818,086

[22] Filed: Jan. 13, 1986

[51] Int. Cl.[5] ..... B01F 5/06

[52] U.S. Cl. ..... 366/340

[58] Field of Search ..... 366/338, 165, 173, 340

[56] References Cited

U.S. PATENT DOCUMENTS

| | | | |
|---|---|---|---|
| 3,206,170 | 9/1965 | Schippers et al. | 366/340 |
| 3,582,048 | 6/1971 | Sarem | 366/340 |
| 3,583,678 | 6/1971 | Harder | 366/340 |
| 3,738,615 | 6/1973 | Brasie | 366/340 |
| 4,087,862 | 5/1978 | Tsien | 366/340 X |
| 4,352,572 | 10/1982 | Chen et al. | 366/340 X |

*Primary Examiner*—Harvey C. Hornsby
*Assistant Examiner*—Scott J. Haugland
*Attorney, Agent, or Firm*—Harold Beck

[57] ABSTRACT

An interfacial surface generating means having an inlet end, an outlet end and a plurality of separate passageways connecting the two ends. The ends of the passageways at the inlet end lie along a first line and the ends of the passageways at the outlet end lie along a second line. The second line extends substantially normal to the first line. Each of the ends being dish-shaped and having connecting means to fasten a plurality of surface generators together in a liquid-tight manner. The adjacent dish-shaped ends forming a mixing chamber between adjacent surface generators.

4 Claims, 2 Drawing Sheets

INTERFACIAL SURFACE GENERATOR

DESCRIPTION OF THE INVENTION

This invention relates to interfacial surface generators which can be constructed of inexpensive material with a minimum of difficulty.

Interfacial surface generators are static mixing devices which mix fluids. The effective mixing in these devices in obtained by the division of a fluid stream into a plurality of sub-streams, recombination of the sub-streams into a main stream and subsequent division and recombination until a desired degree of mixing is obtained. Interfacial surface generators are known in the art and are disclosed in U.S. Pat. No. 3,583,678 and the patents and articles referred to in that patent.

Interfacial surface generators are particularly useful in mixing two or more components requiring intimate mixing and in which the fluids are fairly viscose.

The present interfacial surface generators are easily constructed from materials such as metal or plastic. Important factors in determining the material of construction are cost, simplicity of fabrication and the ability to insure that the material will not interfere with the proper mixing of the liquids which are being mixed. Typical materials of construction are polyethylene, polypropylene and Delrin.

SUMMARY OF THE INVENTION

The interfacial surface generators of the present invention are solid bodies having (i) an inlet end adapted to receive a fluid, (ii) an outlet end adapted to discharge the fluid and a plurality of separate passageways through the body connected to inlet end with the outlet end; both the inlet and outlet ends being concave inwardly and one of the ends having a peripheral edge or wall and the other of the ends defined by a rim or boss extending outwardly. The rim or boss having a configuration that snuggly fits within the peripherial edge or wall in a liquid-tight connection when two interfacial surface generators are joined together in an inlet-to-outlet relationship to each other. Thus the concave ends face each other and form a chamber between the adjacent inlet and outlet ends. The inner surface wall of the chamber is smooth to minimize any hang-up of fluid in the chamber during mixing and purging. The passageways through the body opening on the inlet end lie essentially along a first straight line passing approximately through the center of the inlet end and on the outlet end lying essentially along a second straight line passing approximately to the center of the outlet end. The second line is essentially normal to the first line.

It is believed that the passageways must be sufficiently long in each generator to develop a laminar flow of the liquid in the passageway before the liquid reached the outlet end and is delivered into the chamber formed by the ends of the abutting generators. Also the liquid must have a mass velocity to mix the liquid in the mixing chambers. However, it has been found that the passageways should be maintained at an optimum length thereby reducing the distance between mixing chambers. It is best to have as many mixing chambers in a given length as possible because this provides a maximum number of fluid stream divisions and recombinations as possible within a given length of mixing length. Since the length of mixing tube that can be used on the equipment is sometimes limited, it is desirable to be able to reduce the axially length of the generators to a minimum thereby achieving maximum mixing per unit length of mixer. A major factor in achieving proper mixing is the viscosity of the liquid being mixed.

In using generators of the present invention, it is important that the generators be aligned relative to each other to attain maximum mixing of the fluids and that the individual generators are connected to each other to form a liquid tight passageway so that the fluids being mixed are contained solely within the generators. It is also important in the present invention that the chambers between the generators have a relatively smooth inner surface. In using generators of the type shown in this invention, it is common to mix a base material with a catalyst material. The set time for the mixed material varies depending upon the materials used and the percentage of catalyst used. When the equipment using the generators is shut down, such as for lunch breaks, work curtailment etc., it is necessary to purge the generators so that the catalized material does not set up in the generators thus necessitating a major overhaul of the equipment. To achieve this end, the generators are either purged with a solvent or they are frequently purged with the base material- which is one of the materials being used in the process. The problem with using solvent is that the solvent must be disposed of after its use as a purge and this presents an expensive option in today's environmentally stringent atmosphere. Thus normally the base material is used as a purge. By properly manipulating the equipment using the generators, only the base material is run through the generators. In the prior art devices the generators frequently had many spaces where catalyst and base material would hang up and not be properly flushed from the generators. The end result was that the entire generator portion of the apparatus had to be overhauled. In the present invention chambers between the generators are purged with the base material as are the passageways between the chambers. The chambers are so designed and the flow of material is such that any base-catalyst material which is in the mixed form is swept from the passageways without any significant hangups so that the generators may be effectively purged through use of only a base material.

DETAILED DESCRIPTION OF THE INVENTION

The interfacial surface generators, or static mixers as they are called in the art, are used in mixing fluids, and are used in conjunction with apparatus such as shown in U.S. Pat. No. 4,304,529 and U.S. patent application Ser. No. 532,590.

Figure 5:
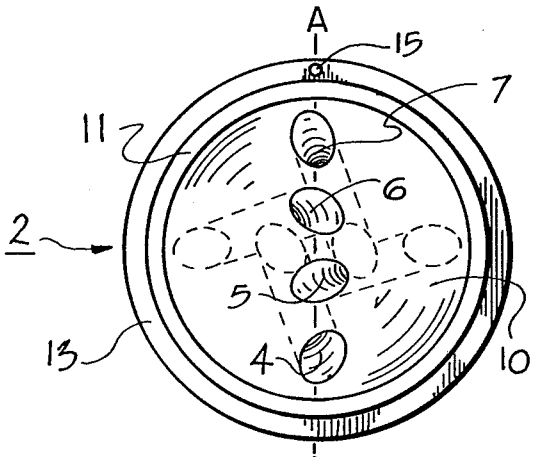
FIG. 5 is an end view of the left-hand end of FIG. 4.
Figure 1:
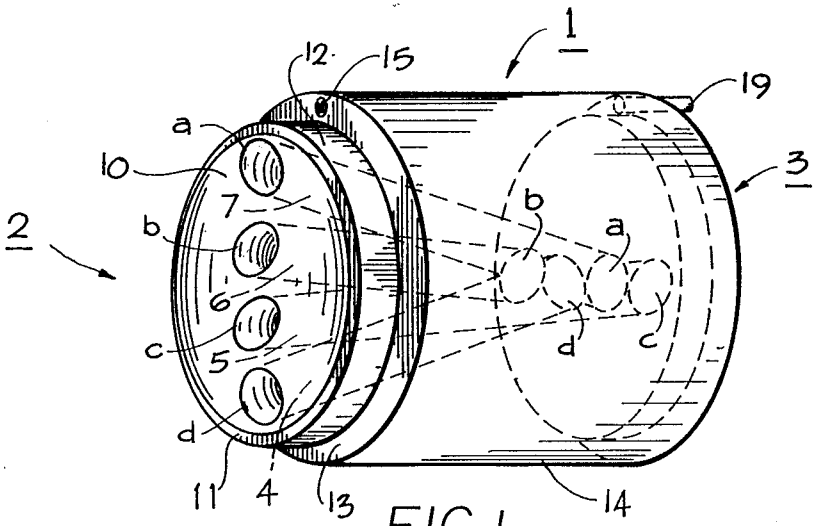
FIG. 1 is a perspective view of an interfacial surface generator according to present invention.

In FIG. 1 there is depicted a single generator means which is a solid body in the form of a cylinder having an inlet end 2 and an outlet end 3 and four passageways 4,5,6 and 7 through the body 1. The passageways open on the inlet end 2 essentially along a straight line A—A shown in FIG. 5. FIG. 5 depicts the openings of the passageways in somewhat of a staggered line but this is in part due to the fact that they are opening on to a curved surface as will be explained hereinafter. Also the precision with which the units are made determine the degree in which the openings come out exactly along line A—A of FIG. 5. It is not deemed that this is a critical feature of the present invention so long as the openings are approximately along line A—A to provide a mixing effect between the fluids being mixed.

Figure 6:
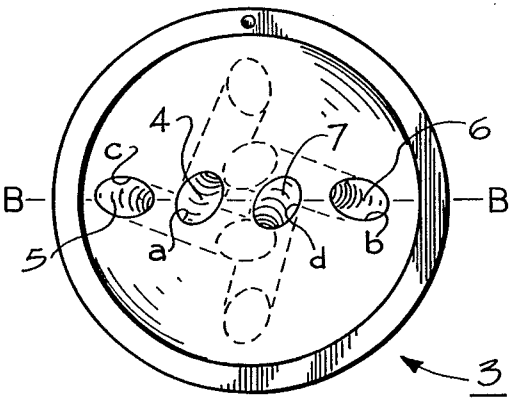
FIG. 6 is an end view of the right-hand end of FIG. 4.
Figure 2:
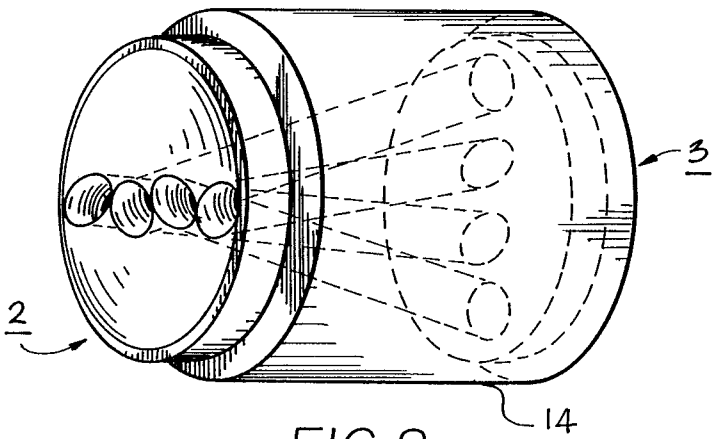
FIG. 2 is a view similar to FIG. 1 but the generator is rotated 90 degrees.
Figure 4:
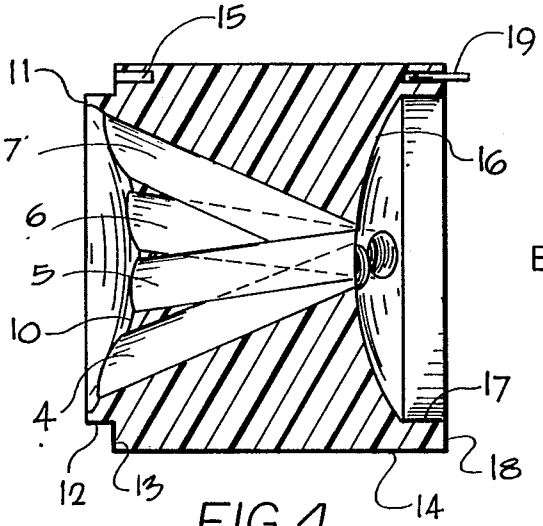
FIG. 4 is a cross-sectional view of the generator taken on a line 4—4 of FIG. 3.

The passageways open on the outlet end 3 in the configuration shown in FIG. 6. The openings a,b,c and d in outlet end 3 extend approximately along line B—B. The line B—B is normal to line A—A.

The inlet end 2 has an inwardly dished portion 10 into which the inlet openings a,b,c and d of passageways 4,5,6 and 7 respectively open. These openings a,b,c and d appear as ovals on the surface due to the curvature of the surface and the angle of the passageway.

The dish portion has a small rim 11 extending around its periphery and axially of the body. The rim 11 is joined with a cylindrical wall 12 which projects outwardly from the body 1 and terminates in a shelf 13. The shelf 13 extends radially outward from the cylindrical body 1 and terminates at the outer wall 14 of body.

The dished portion of end 2 has a radius of about 1 and 1/16 inches and extends inwardly from rim 11 approximately 0.115 inches. The dish portion may vary in dimensions but must have a configuration that forms a closed chamber when two of the units are joined together in a manner to be described hereinafter.

For use in the present invention the passageways 4,5,6 and 7 have a diameter of about 0.20 inches. The diameter of these holes is quite important to give flow characteristics to the materials being mixed. It is important in mixing materials that they have a straight line flow such as in passages 4,5, 6 and 7 and a turbulent flow such as in the chamber form between adjacent mixing elements in the manner described hereinafter.

The end 2 also has a small hole 15 which allows adjacent mixing elements to be aligned in a manner described hereinafter.

The outlet end 3 has a dished portion 16 of a configuration matching the dish portion 10 of end 2, and the outlets a,b,c and d of the passageways 4,5,6 and 7 respectively open into the dished surface. The dished surface 16 is surrounded by a cylindrical surface 17. The surface 17 has a dimension just sufficient to receive the inlet end 2 and wall 12 tightly fits against wall 17 when adjacent mixing elements are pushed together. The end 3 terminates in a surface 18 which engages against surface 13 of end 2.

Figure 3:
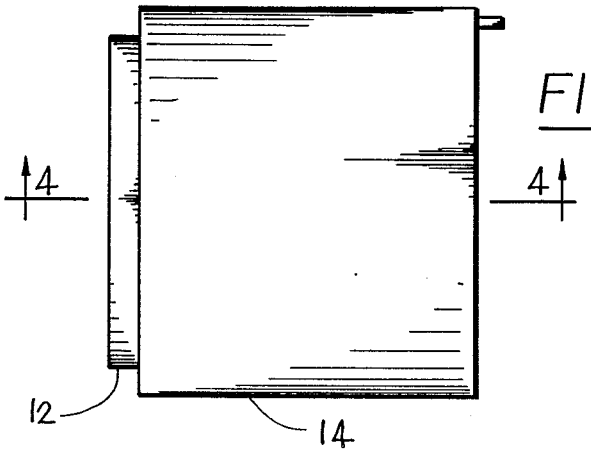
FIG. 3 is a side view of a generator shown in FIG. 2.

An aligning pin 19 is mounted in the surface 18 and has a position corresponding to the opening 15 in end 2 such that adjacent mixing elements can be joined only when the aligning pin 19 enters the opening 15 of an adjacent mixing element. This insures that the line A—A FIG. 3 is always normal to the line B—B of FIG. 6 when adjacent mixing elements are joined together.

Figure 7:
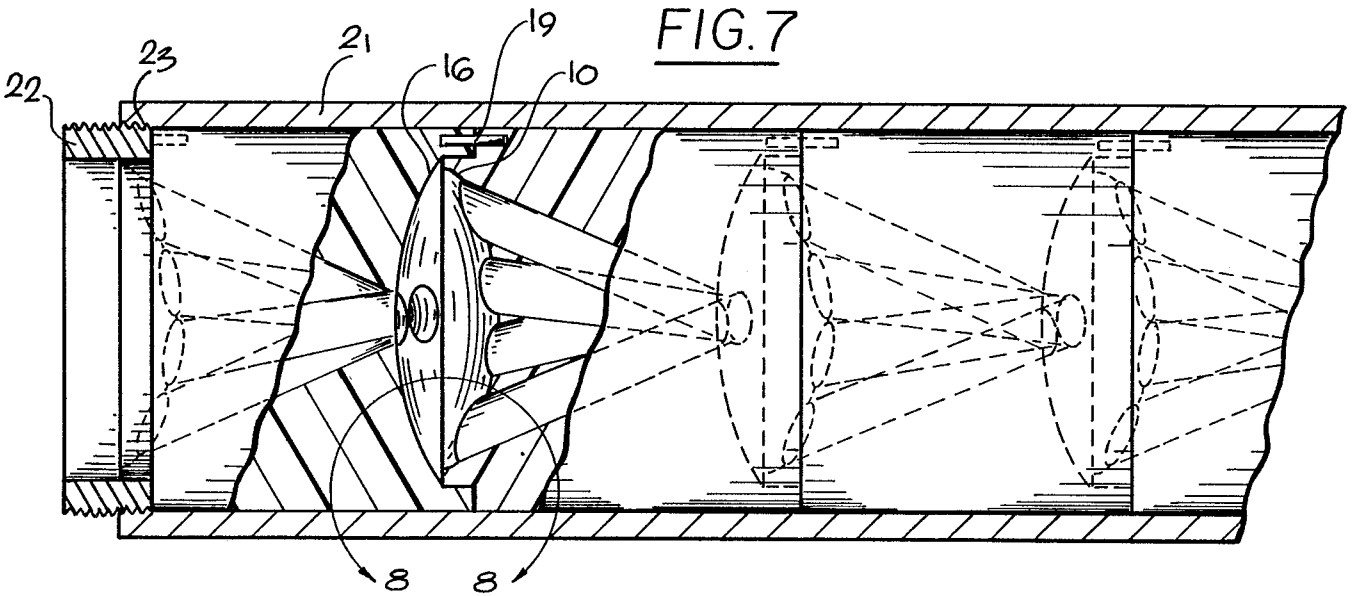
FIG. 7 is a side elevation view partly in cross-section, of the generators assembled together in a working relationship to each other.
Figure 8:
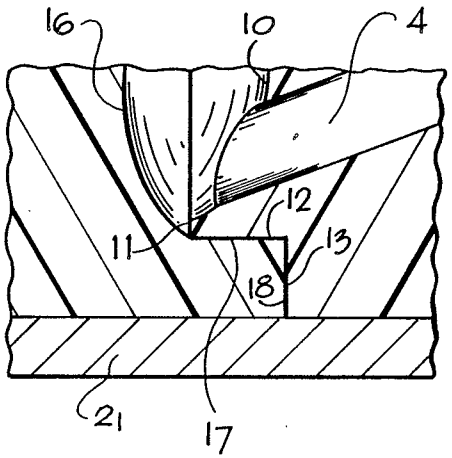
FIG. 8 is an enlarged view of section 8—8 of FIG. 7.

FIGS. 7 and 8 show the mixing elements joined together and mounted in a tube 21 which is used with equipment shown in the previously identified patent and patent application so that one end of tube 21 receives the flow of the two or more liquid materials which are to be mixed and the other end of the tube discharges the mixed liquids for their intended use. The individual elements are tightly clamped together by a locking ring 22 which threads into threads 23 at one end of the tube 21. A similar locking device is used at the other end of the tube 21 so that the mixing elements are tightly locked together. The two mixing elements are locked together as show in FIG. 8 with the wall 12 tightly engaging the wall 17. This is an interference fit having only about 0.001 inch clearance between the walls. This is referred to herein as a liquid-tight fit. Of course when the mixing elements are fabricated from a plastic material there is some resilience and the plastic materials have a gasketing effect relative to each other. In any event the walls 12 and 17 form a liquid-tight fit so that a chamber is formed between the dished portions 10 and 16. This dished chamber is shown best in FIG. 7. It is believed that the liquid materials entering the chamber create somewhat of a swirling effect in the chamber prior to entering the passageways on the adjacent mixing element. It has been found that when the mixing elements are purged either with a base material or a solvent, the chambers and passageways are cleanly swept out with the purging material so that there is no chance of the materials setting up in the chambers thereby necessitating dismantling the equipment for cleanout.

Note the pins 15 properly align the mixing elements configuration relative to each other is as shown in FIG. 7. It is important that the elements be maintained in this configuration whereby the line A—A of FIG. 5 is normal to the line B—B of FIG. 6 in each of the adjacent elements.

Various other sealing configurations can be effective between adjacent mixing elements however, configurations shown in the present drawings is the preferred embodiment.

It is important to note that the mixing elements cannot be put in the equipment backwards relative to the flow of materials. This is an important feature.

While I have described a preferred embodiment of my invention, it may be otherwise embodied within the scope of the following claims.

I claim:

1. An interfacial surface generator comprising a body having (a) an inlet end, (b) an outlet end, and (c) a plurality of separate passageways through the body; both said inlet and outlet ends being concave inwardly; one of said ends having a peripheral edge and the other of said ends defined by a boss extending outwardly; said boss having a configuration that snuggly fits within and is in liquid-tight engagement with said peripheral edge when two interfacial surface generator bodies are put together inlet-to-outlet so that said concave ends face each other and form a liquid-tight chamber between the adjacent inlet and outlet ends; said passageways opening (1) on the inlet end essentially along a first line lying approximately through the center of the inlet end and (2) on the outlet end essentially along a second line lying approximately through the center of the outlet end, and the second line being essentially normal to the first line.

2. The interfacial surface generator of claim 1 wherein said body is fabricated from yieldable materials such that when two interfacial surface generator bodies are put together inlet to outlet, the bodies are releasibly connected by a liquid-tight seal between them.

3. The interfacial surface generator of claim 1 having a plurality of said bodies securely held together to each other by liquid-tight seals between the bodies.

4. An interfacial surface generator for mixing a liquid stream comprising a plurality of generating means securely held together in liquid-tight relationship to each other; each generating means comprising a solid body having (i) and inlet end, (ii) an outlet end, and (iii) a plurality of passageways through the body connecting the two ends, each passageway diverting a portion of the liquid stream at the inlet end and delivering the diverted stream at the outlet end at a radially different point than the inlet point; the inlet and outlet ends in abutting generating means forming an enclosed, liquid-tight chamber into which the diverted streams are introduced and mixed;

said inlet and outlet ends being dished axially inward, and said dished ends being positioned facing each other when the generating means are fastened together to form a mixing chamber with the generating means.

* * * * *